US005222714A

United States Patent [19]

Morinigo et al.

[11] Patent Number: 5,222,714

[45] Date of Patent: Jun. 29, 1993

[54] ELECTROMAGNETICALLY ACTUATED VALVE

[75] Inventors: Fernando B. Morinigo, Los Angeles; Keith O. Stuart, Cypress, both of Calif.

[73] Assignee: Aura Systems, Inc., El Segundo, Calif.

[21] Appl. No.: 957,194

[22] Filed: Oct. 5, 1992

[51] Int. Cl.[5] ..... F16K 31/06

[52] U.S. Cl. ..... 251/129.16; 251/129.1; 123/90.11

[58] Field of Search ..... 251/129.16, 129.1; 123/90.11

[56] References Cited

U.S. PATENT DOCUMENTS 4,719,882 1/1988 Kreuter ..... 251/129.16 X 5,131,624 7/1992 Kreuter et al. ..... 251/129.16

*Primary Examiner*—Arnold Rosenthal

*Attorney, Agent, or Firm*—Anthony T. Cascio; Lisa A. Clifford

[57] ABSTRACT

An electromagnetically actuated valve is disclosed having an upper electromagnetic element and a lower electromagnetic element, each of the elements having a toroidal configuration or an annular configuration with a U-shaped cross-section. The elements each define a central chamber and a central channel. The upper and lower electromagnetic elements are in a mirrored relationship to each other. The valve also includes a core element having an annular horizontal cross-section and is disposed intermediate the upper and lower electromagnetic elements. A coil is disposed within the central channel of each of the electromagnetic elements. A valve stem is disposed within the central chamber of the electromagnetic elements. A spring is disposed within the central chamber of the electromagnetic elements for biasing the electromagnetic elements in a neutral position. A connecting plate connects the core elements to the valve stem. Applying current to the coil in the upper electromagnetic element causes the valve to close, and interrupting the current to the coil in the upper electromagnetic element and applying current to the coil in the lower electromagnetic element causes the valve to open.

16 Claims, 3 Drawing Sheets

ELECTROMAGNETICALLY ACTUATED VALVE

FIELD OF THE INVENTION

The present invention relates generally to an electromagnetically actuated valve, and more particularly to an electromagnetically actuated valve with a unique electromagnetic design to allow the opening and closing of the valve at high frequency while using less power.

BACKGROUND OF THE INVENTION

In the past, valves have been designed for opening and closing mechanisms that combine the action of springs with electromagnets. However, the earlier designs did not operate quickly enough to open and close the valves with sufficient speed. For example, valves using spring action could not be designed with the speed normally required for the opening and closing of an internal combustion engine's intake and exhaust valves, or for the speed required for air compressors.

There are several clear physical factors for the reason why the earlier valve designs could not operate at the desired high speeds. First, the forces that an electromagnet can exert are proportional to the area of the pole faces of the electromagnet. Second, the moving piece must provide a return path for the magnetic flux that has the same cross-sectional area, perpendicular to the flux, as the pole faces. Third, there is a practical limit to the size of the magnetic field that can be created by in ferromagnetic materials. This limiting factor is referred to as saturation. These three physical factors act together such that, in previous designs, the mass of the piece providing the return path for the magnetic flux could not be made small enough so that it could be accelerated quickly enough for the desired applications, such as the modern internal combustion engines.

SUMMARY OF THE INVENTION

Accordingly, it is a primary object of the present invention to overcome one or more disadvantages and limitations of the prior art.

A significant object of the present invention is to provide an electromagnetic valve that provides a sufficient pole face area to create the desired electromagnetic forces.

Another object of the present invention is to provide an electromagnetic actuator that provides a return flux path with sufficient area to create the desired electromagnetic forces.

Another object of the present invention is to provide electromagnetic actuator with a small enough moving mass to allow valve operation at higher speeds and higher frequency than the prior art.

According to a broad aspect of the present invention, an electromagnetically actuated valve comprises at least one pair of electromagnetic elements, each pair of electromagnetic elements further comprising an upper electromagnetic element and a lower electromagnetic element, each of the electromagnetic elements having an annular horizontal cross-section defining a central chamber, and a substantially arc-shaped vertical cross-section, wherein the arc-shaped cross-section defines a central channel, and further wherein the upper and lower electromagnetic elements of the pair are in a mirror relationship to each other. Each electromagnetic pair includes a core element having an annular horizontal cross-section and is disposed intermediate the upper and lower electromagnetic elements. A coil is disposed within the central channel of each of the electromagnetic elements. A valve stem and spring are disposed within the central chamber of the electromagnetic element, with the spring biasing the electromagnetic elements in a neutral position. A connecting plate connects the core elements to the valve stem. Therefore, when current is applied to the coil in the upper electromagnetic element, the valve closes. When the current to the coil in the upper electromagnetic element is interrupted, and current is applied to the coil in the lower electromagnetic element, the valve opens.

A feature of the present invention is that the pole faces of the electromagnets provide a larger pole face area than the prior art.

Another feature of the present invention is that the design of the electromagnets and core element provide a large magnetic field, while using a relatively small amount of energy.

Another feature of the present invention is that the shape of the core elements provides a larger pole face area than the valves of the prior art.

Yet another feature of the present invention is that the design of the core assembly provides for a moving core assembly with a smaller mass than the prior art.

Still another feature of the present invention is that the magnetic flux paths of the electromagnetic circuit provide an efficient magnetic circuit with very little wasted flux.

These and other objects, advantages and features of the present invention will become readily apparent to those skilled in the art from a study of the following description of an exemplary preferred embodiment when read in conjunction with the attached drawing and appended claims.

DESCRIPTION OF AN EXEMPLARY PREFERRED EMBODIMENT

Figure 1:
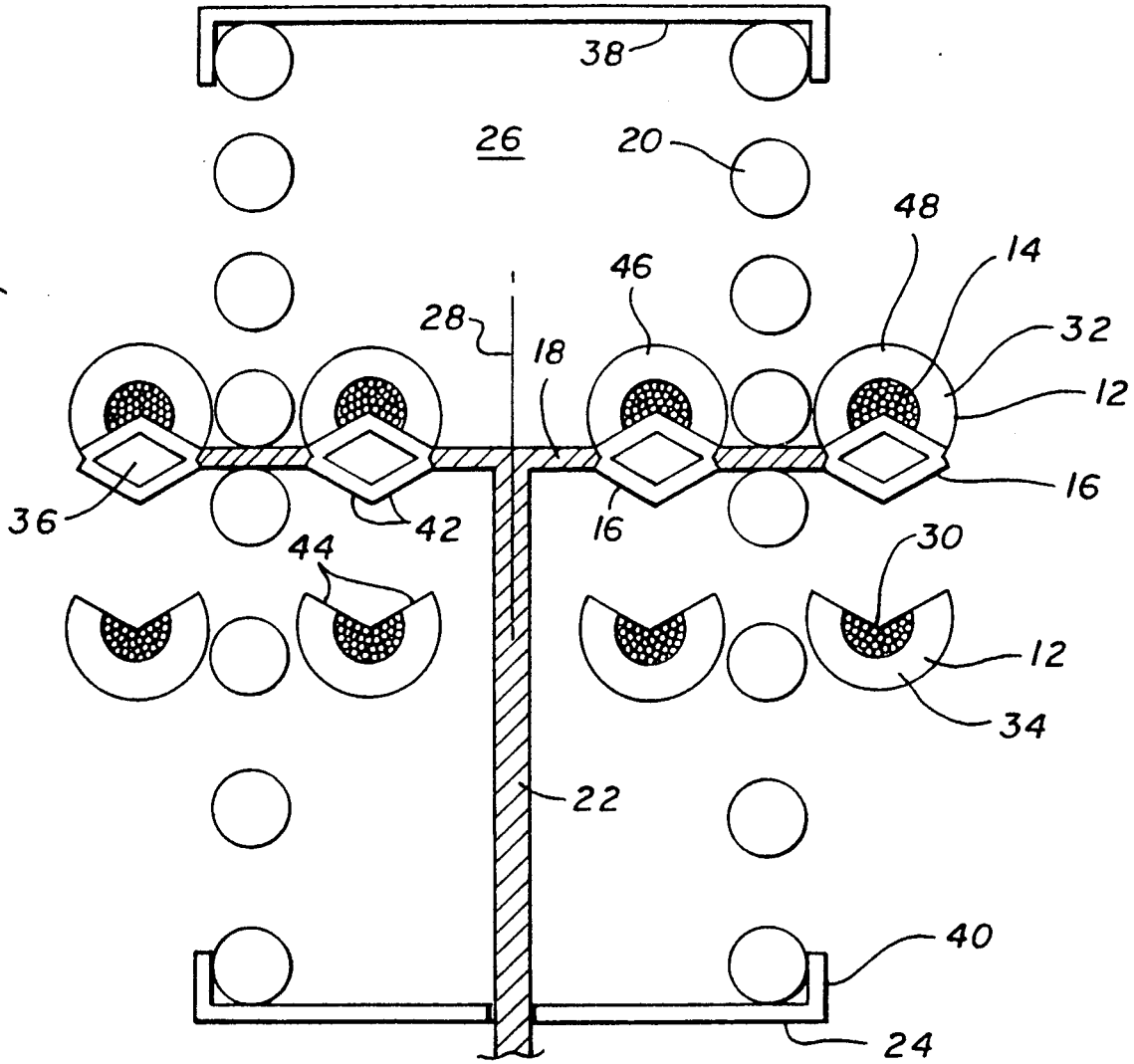
FIG. 1 is a cross-sectional view of one embodiment of electromagnetically actuated valve of the present invention.

Referring now to FIG. 1, one embodiment of a valve 10 of the present invention is shown in cross-section. In the embodiment shown, the valve 10 includes two pairs of electromagnetic elements 12, a plurality of coils 14, two core elements 16, a connecting rod 18, a spring 20, a valve stem 22, and a valve case 24. Each of the electromagnetic elements 12 are preferably toroidal-shaped, and extend annularly around the valve stem 22. The annular shape of the electromagnetic elements 12 defines a central chamber 26. The central chamber 26 further defines a central vertical axis 28. The elements 12 are, as shown in FIG. 1, not a closed toroid, but rather have a cross-sectional configuration of an arc or a substantial U-shape (shown in FIG. 5). The electromagnetic elements 12 therefore each define two open faces 44, which lead into a central channel 30 within the electromagnetic elements 12. The open faces 44 provide a large electromagnetic pole face area.

The coil elements 14 extend within the channel 30 of the electromagnetic elements. The central location of the coil elements and the cross-sectional shape of the electromagnetic elements provides maximized magnetomotive force, with minimal resistance, and therefore maximum power.

Each pair of electromagnetic elements 12 further comprises an upper electromagnetic element 32 and a lower electromagnetic element 34. The upper and lower electromagnetic elements are in a mirrored relationship to each other, with the central channels 26 of the upper and lower electromagnetic elements being in a facing relationship to each other.

Disposed intermediate the upper and lower electromagnetic elements 32, 34 is the core element 16. The core element 16 is preferably annular-shaped in horizontal cross-section, and substantially rhomboidal-shaped in vertical cross-section. The rhomboid shape serves to reduce the mass of the core element. The rhomboidal shape of the core element 16 also preferably includes an aperture 36 in the center, in order to reduce the mass of the core element 16. The rhomboid-shaped also provides the core element with four faces 42 for a relatively large pole face area. The four faces 42 are also angled for maximum contact with the electromagnetic elements 32, 34. The angle of the pole faces relative to the stroke motion of the valve serves to reduce the amount of current required to pull the valve from an open to closed position, and vice versa.

Opposing ends of the core element 16 are secured to each other via the connecting rod or plate 18. The connecting bar 18 is further secured to the valve stem 22, preferably at the center of the connecting bar 18. The valve stem 22 preferably extends in axial alignment with the central vertical axis 28 of the central chamber 26 of the electromagnetic elements 12.

The spring 20 is also disposed within the central chamber 26, preferably surrounding the valve stem 22. The valve case 24 also includes an upper portion 38 and a lower portion 40 which the spring 20 contacts.

Figure 2:
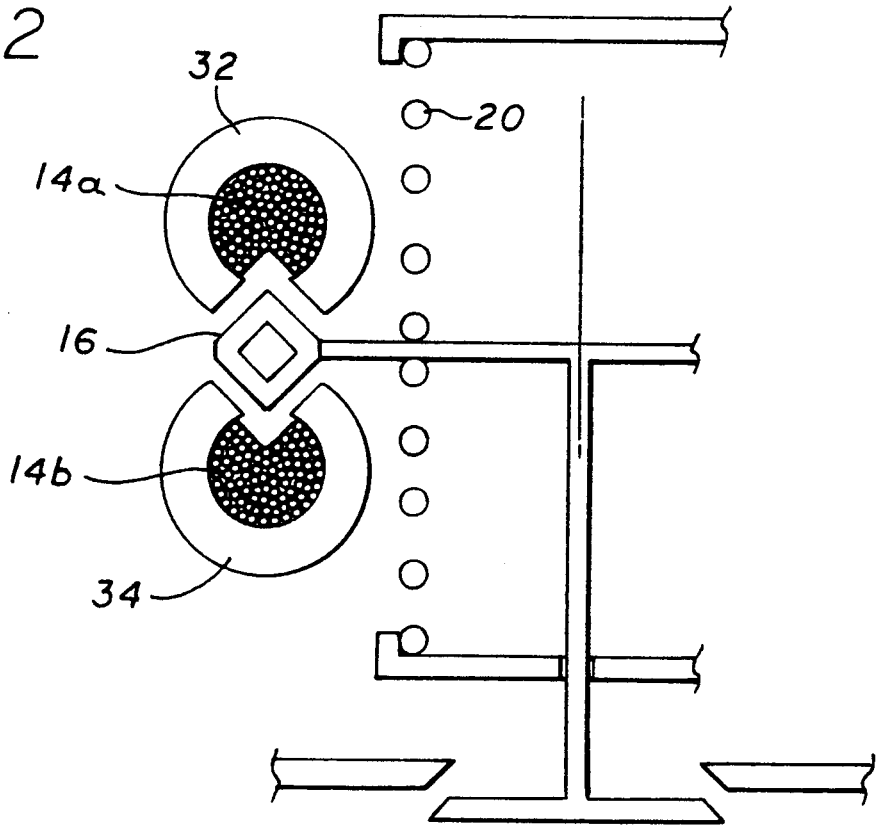
FIG. 2 is a cross-sectional view of another embodiment of the valve, showing the valve in its neutral unpowered position.
Figure 3:
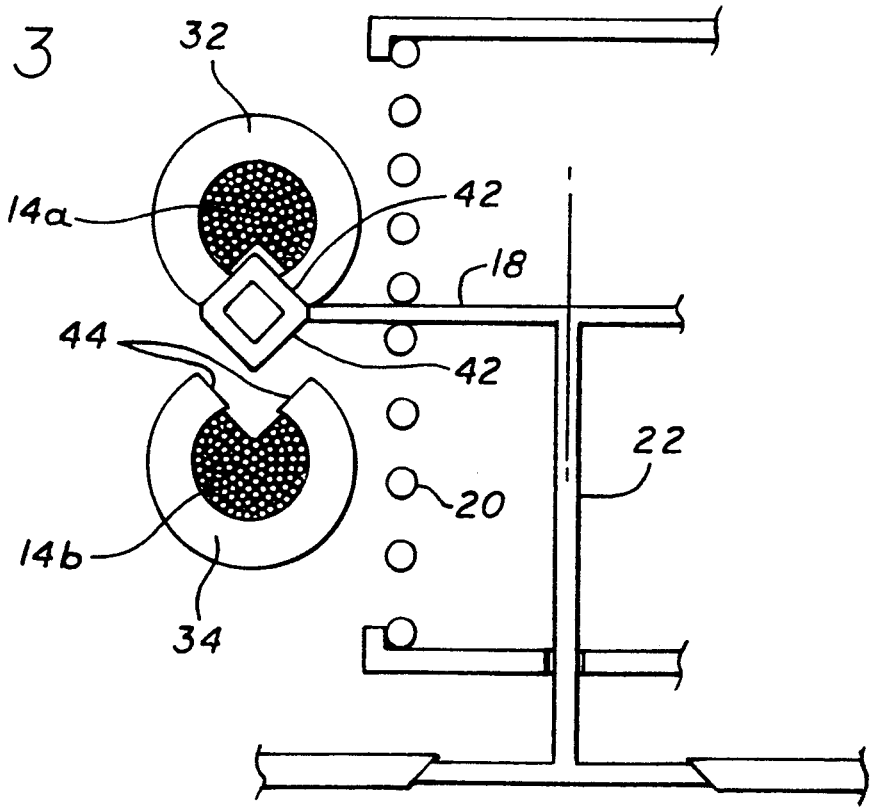
FIG. 3 is a cross-sectional view of the embodiment of the valve of FIG. 2, showing the valve in its closed position.
Figure 4:
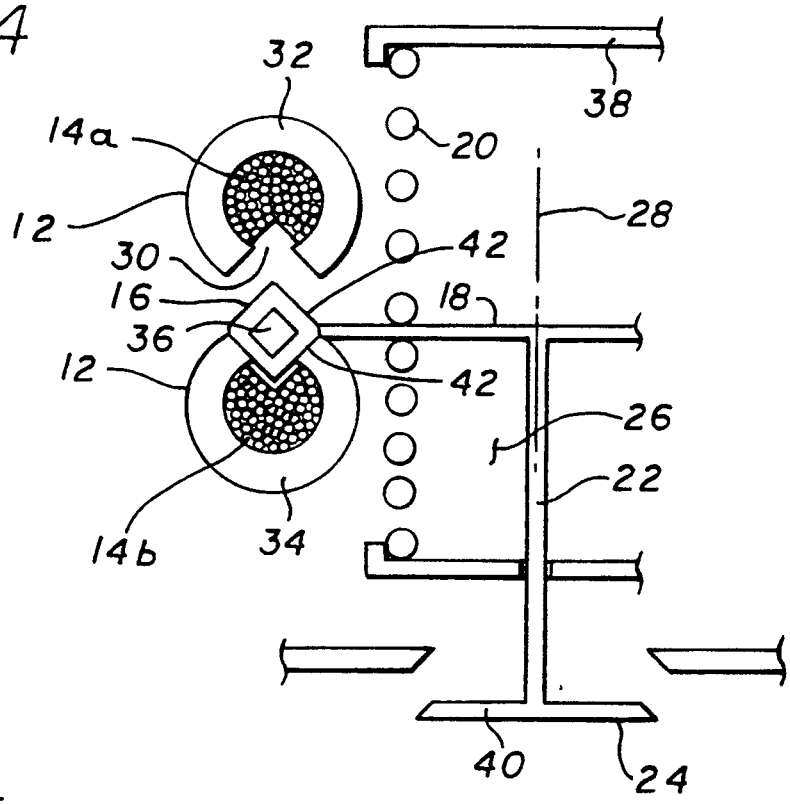
FIG. 4 is a cross-sectional view of the embodiment of the valve of FIG. 2, showing the valve in its open position.

Referring now to FIGS. 2, 3, and 4, the operation of the valve 10 will be described. It is to be noted that in this context, the core assembly 16 includes the core and the assembly connected to the core for each particular application. FIG. 1 shows the valve in its neutral, unpowered state. The spring 20 hold the core 16 halfway between the upper and lower electromagnets 32, 34, in the equilibrium position. FIG. 2 shows the valve in its closed position. In order for the valve 10 to change from the neutral position to the closed position, a high current short duration pulse is applied to coil 14*a*, creating an electromagnetic force that attracts the core 16 to the upper electromagnet 32. The electromagnetic force overcomes the forces of the spring 20 and therefore drives the valve 10 to its closed position. Once the valve 10 is in its closed position, only a small steady current in the coil 14*a* is necessary to maintain the valve 10 in its closed position.

The core 16 remains in the closed position as long as the attractive force between the core 16 and the electromagnet 32 is greater than the force with which the spring 20 tries to restore the core 16 the its neutral position. In order to open the valve 10, the current flowing through the coil 14*a* is interrupted. When the current is interrupted, the spring 20 drives the core assembly 16 back toward the neutral position, gaining speed as its approaches the neutral position. The net force of the spring 20 on the core assembly 16 is zero at the neutral position, however, by Newton's law of motion, at maximum velocity. The velocity, therefore, carries the core assembly 16 past the neutral position. Once the core assembly 16 is past the neutral position, the spring 20 exerts forces on the core assembly 16 opposing the velocity, which decelerates the core assembly 16 as it approaches the lower electromagnet 34.

In the case of very small friction, the moving core assembly 16 will move past the neutral position to a distance from the neutral position approximately equal to the distance from the neutral position from which it started on the opposite side. As the core assembly 16 approaches the lower electromagnet 34, a relatively small current in the coil 14*b* is sufficient to provide a force to compensate for energy lost due to the mechanical friction and spring damping. The current in coil 14*b* is also sufficient to hold the valve in the open position, as shown in FIG. 4.

When the valve 10 is in its operational powered state, the energy required to drive the valve 10 from the open position to the closed position, or vice versa, is furnished almost entirely by the energy stored in the compressed spring 20. A small amount of energy lost to friction is provided by the attraction of the core assembly 16 to the lower electromagnet 34, which begins as soon as the current is turned on in the coil 14*b*. Thus, preferably the coil 14*b* is turned on early in the valve opening sequence, closely following the interruption of the current in the coil 14*a*.

Therefore, as previously described, the design of the present invention solves the problems of providing sufficient pole face area, a sufficient flux return path, and a sufficiently large magnetic field to provide the desired force, while maintaining a sufficiently small moving mass to allow valve operation at desired speeds of revolution.

Figure 5:
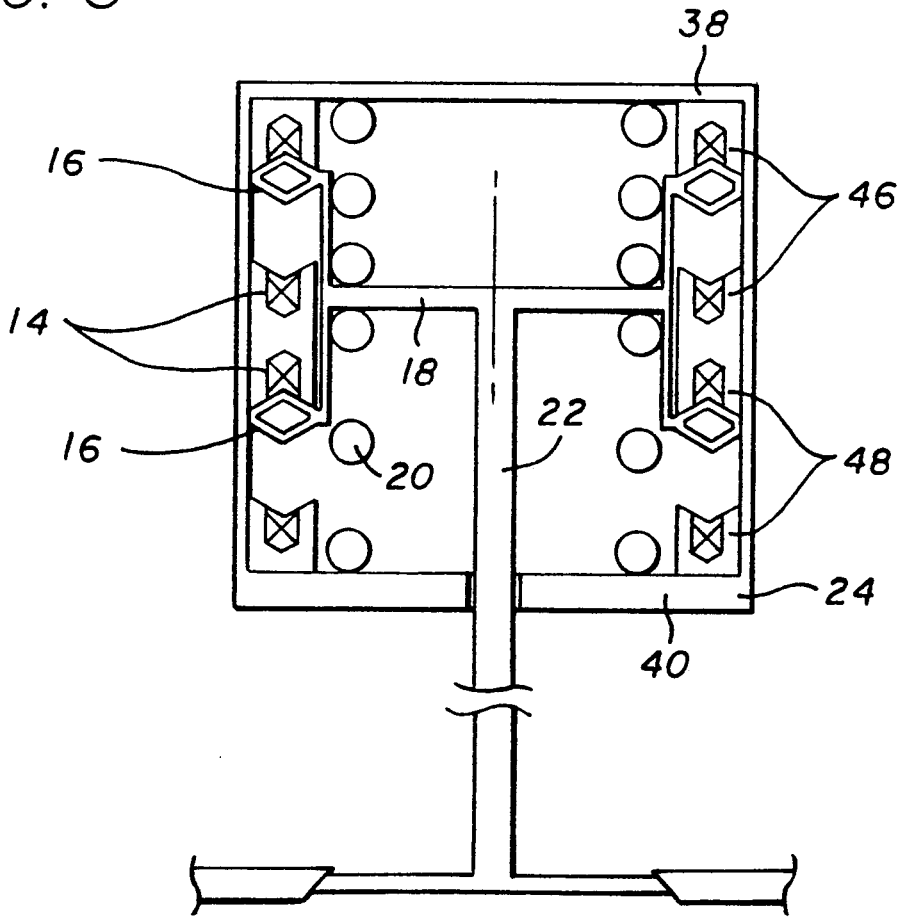
FIG. 5 is a cross-sectional view of an alternative embodiment of the electromagnetically actuated valve of the present invention.

Referring now to FIG. 5, another embodiment of the valve 10 of the present invention is shown. In this embodiment, a first pair 46 and a second pair 48 of electromagnetic elements are utilized. The first pair of electromagnets 46 are stacked on top of the second pair of electromagnets 48. In comparison, in the embodiment of the invention shown in FIG. 1, the first pair of electromagnets 46 is disposed between the second pair of electromagnets 48 and the valve stem 22. The use of multiple electromagnetic element pairs and cores is significant in that it reduces the mass required to complete the magnetic circuit, without reducing the area allocated for the flux. Therefore, although the current and power requirements will increase with multiple electromagnet pairs and cores, the total current and power requirement remains desireably manageable.

Referring back to FIG. 1, the process of calculating the required values for the dimensions designated on FIG. 1 is explained. First, the basic dimensions, shown on FIG. 1, are as follows:

b = outer radius of each of the toroidal-shaped electromagnetic elements;

a = inside radius of each of the toroidal-shaped electromagnetic elements;

$r_1$ = radius of center circle of inner toroidal element;

$r_2$=radius of center circle of outer toroidal element, wherein $r_2=r_1+2b$;

$\theta$=angle between moving core element and plane perpendicular to vertical axis;

S=valve stroke;

p=mass density of moving core element;

m=mass of moving core assembly minus the core mass;

w=angular frequency of valve motion from spring restoration forces.

The values of b and $\theta$ are determined by optimization equations. The parameter a is fixed indirectly in terms of the dimensionless quantity $$\delta=\tfrac{1}{2}(1-a/b) \tag{1}$$

which is assigned a fixed value. The mean radius of the two toroids, R, wherein $$R=\tfrac{1}{2}(r_1+r_2) \tag{2}$$

is left as a free parameter, such that the results are displayed as functions of R.

The area of the cross section of the moving magnetic core piece is expressed as the area of four rectangles minus the area of four trapezoids. With the rectangle length being equal to b, and the width being equal to $\frac{1}{2}(b-a)$, or b, the area of the cross-section of the moving core is:

$$\text{area}=4b^2\delta(1-\delta\tan\theta) \tag{3}$$

The volume of the moving core is:

$$\text{volume}=2\pi(r_1+r_2)4b^2\delta(1-\delta\tan\theta) \tag{4}$$

The mass of the moving magnetic core piece is expressed in the following terms:

$$m+p\ 16\pi R\ b^2\delta(1-\delta\tan\theta) \tag{5}$$

When the moving core is in contact with the electromagnets, the total area is expressed as:

$$A=2\pi(r_1+r_2)4b\delta=16\delta R\ b\delta \tag{6}$$

The magnetic force is expressed in terms of the mean magnetic induction field B, the area in contact A, the tilt angle, and the permeability of open space u as:

$$\text{force}=A\ B^2\cos\theta/2u_o \tag{7}$$

To ensure that the spring force on the moving assembly equals the magnetic force when the displacement is one-half the stroke, the following equation must be satisfied:

$$[m+p16\pi R\ b^2\delta(1-\delta\tan\theta)]\mu_0\omega^2S=B^2 16\pi R\ b\ \delta\cos\theta \tag{8}$$

Equation 8 is the basis for the optimization of b and angle. In order to optimize b, the value of b that minimizes the following equation is determined:

$$\frac{m}{b}+b\ \rho\ 16\pi R\delta(1-\delta\tan\theta) \tag{9}$$

The result of setting the derivative of equation 9 with respect to b at zero is the following:

$$b=\frac{1}{\sqrt{(\rho/m)\ 16\pi R\delta(1-\delta\tan\theta)}} \tag{10}$$

With this choice of b, both sides of equation 9 are equal. Adopting this optimal value of b, the condition that the magnetic force balances the spring restoring force becomes:

$$\mu_0\omega^2S\sqrt{\rho m\ 16\pi R\delta(1-\delta\tan\theta)}=B^2\ 8\pi R\delta\cos\theta \tag{11}$$

For optimization, both sides of equation 11 are divided by cos and the identity $\sec^2\theta=1+\tan^2\theta$ is substituted into the equation. The following function of results:

$$(1+\tan^2\theta)\ (1-\delta\tan\theta) \tag{12}$$

Values of $\theta$ that exceed $\pi/4$ cannot be used, because such values imply that the pole face surfaces of the moving core are no longer flat where they have to be in order to contact the electromagnetic element surfaces. By taking the derivative of equation 12 with respect to tan $\theta$ and setting the result equal to zero, a quadratic equation is obtained with a usable smaller root. The result is:

$$\tan\theta=\frac{2}{3\delta}\left(1-\sqrt{1-3\delta^2}\right)\simeq\delta \tag{13}$$

Because the value of $\delta$ lies between 0 and $\frac{1}{2}$, the linear approximation to the square root gives a qualitatively correct idea of the value of the optimal tan $\theta$. The square of the magnetic induction field is expressed as:

$$B^2=\mu_0\omega^2S\sqrt{\frac{m\ \rho(1+\tan^2\theta)(1-\delta\tan\theta)}{4\pi R\delta}} \tag{14}$$

This equation is valid for any value of $\theta$. If the angle $\theta$ is adjusted to maximize the ratio $\omega^2/B^2$, then tan $\theta$ depends on $\delta$ as specified by equation 13.

In order to determine the required current, first assume that a value for R and B have been selected. The magnetomotive force or number of ampere turns that are required to maintain the magnetic induction field B is estimated from the permeability of the materials from which the electromagnet and core elements are constructed.

For an initial estimate, the length of the path in the ferromagnetic material is set to equal the circumference of a circle of radius equal to the average of a and b, which equals $2\pi b\ (1-\delta)$. From Ampere's Law applied to the magnetic circuit in either of the toroids:

$$NI=(B/\mu)2\pi b(1-\delta) \tag{15}$$

An important requirement of the present invention is that the magnetic fields produced by the coil currents be great enough to pull the valve to the closed or open position when the gap is one half the stroke. If x represents the displacement of the moving core from its neutral position, the core comes into contact with the electromagnetic element when $x=\frac{1}{2}$ S. If the magnetic force is first expressed in terms of ampere turns NI, the area of contact, A, and a length equivalent of the path within the ferromagnetic material $L=2\pi b\,(1-\delta)/(\mu/\mu_0)$, then the requirement to overcome spring force may be expressed as:

$$\frac{1}{2}\frac{\mu_0 (NI)^2 A \cos\theta}{[L + (S - 2x)\cos\theta]^2} = kx = \frac{B_0^2 A}{\mu_0 S} x \tag{16}$$

Treating L as a constant, the maximum value of NI is required for $x=S/6+L/(6\cos\theta)$. If the stiffness k of the spring is expressed in terms of the magnetic field $B_0$ required to hold the valve open or closed, the result is:

$$(NI) = \frac{B_0 (2S/3 - L/3)\sqrt{(1/3 + 2L/3S)}}{\mu_0\sqrt{1 + \tan^2\theta}} \tag{17}$$

In equation 17, $B_0$ represents the magnetic induction necessary to hold the valve in either a closed or or open position, and NI is the maximum current required to pull the valve to the open or closed position from its neutral position.

It should be noted that it is also possible to utilize the valve of the present invention in order to actuate an external load. In this embodiment of the invention, the valve stem is comprised of an actuator rod, which is connected to the external device. The upper and lower electromagnetic elements are then energized sequentially at a resonant frequency, in order to resonate the spring mass system. Therefore, the actuator actuates the external load, while maintaining a low current requirement.

There has been described hereinabove an exemplary preferred embodiment of the actuator according to the principles of the present invention. Those skilled in the art may now make numerous uses of, and departures from, the above-described embodiments without departing from the inventive concepts disclosed herein. Accordingly, the present invention is to be defined solely by the scope of the following claims.

I claim as my invention:

1. An electromagnetically actuated valve comprising:

at least one pair of electromagnetic elements, each pair of electromagnetic elements further comprising an upper electromagnetic element and a lower electromagnetic element, each of said elements having an annular horizontal cross-section defining a central chamber, and a substantially U-shaped vertical cross-section, wherein said U-shaped cross-section defines a central channel, and further wherein upper and lower electromagnetic elements of said pair are in a mirror relationship to each other;

at least one core element, said core element having an annular horizontal cross-section and a substantially rhomboid-shaped vertical cross-section and being disposed intermediate said upper and lower electromagnetic elements;

a coil disposed within the central channel of each of said electromagnetic elements;

a valve stem disposed within the central chamber of the electromagnetic elements;

a spring disposed within the central chamber of the electromagnetic elements, said spring biasing said electromagnetic elements in a neutral position; and a connecting plate, said connecting plate connecting said core elements to said valve stem,;

wherein applying current to the coil in the upper electromagnetic element causes the valve to close, and interrupting the current to the coil in the upper electromagnetic element and applying current to the coil in the lower electromagnetic element causes the valve to open.

2. An electromagnetically actuated valve in accordance with claim 1 wherein said rhomboidal-shaped core element further defines a central aperture.

3. An electromagnetically actuated valve in accordance with claim 1 wherein the valve comprises a first and a second pair pairs of electromagnetic elements.

4. An electromagnetically actuated valve in accordance with claim 3 wherein the first pair of electromagnetic elements and core elements is stacked on top of the second pair of electromagnetic elements.

5. An electromagnetically actuated valve in accordance with claim 3 wherein the first pair of electromagnetic elements is disposed intermediate the valve stem and the second pair of electromagnetic elements.

6. An electromagnetically actuated valve in accordance with claim 1 further comprising a valve case, said valve case surrounding said electromagnetic elements and core elements, and further wherein an upper and a lower surface of the valve case serves to bias the spring.

7. An electromagnetically actuated valve in accordance with claim 1 wherein said U-shaped cross-section of said electromagnetic elements defines two angled electromagnetic element pole faces, and further wherein said core element further defines four core pole faces, said core pole faces being angled to correspond to the angled electromagnetic pole faces.

8. An electromagnetically actuated valve comprising:

at least one pair of electromagnetic elements, each pair of electromagnetic elements including an upper electromagnetic element and a lower electromagnetic element, said elements each having an annular horizontal cross-section defining a central chamber, and a substantially arc-shaped vertical cross-section, wherein said arc-shaped cross-section defines a central channel, and further wherein said central channels of said upper and lower electromagnetic elements are in facing relationship to each other;

at least one core element, said core element having an annular horizontal cross-section and being disposed intermediate said central channels of at least one pair of said electromagnetic elements;

a coil disposed within the central channel of each of said electromagnetic elements;

a valve stem disposed within the central chamber of the electromagnetic elements;

a spring disposed within the central chamber of the electromagnetic elements, said spring biasing said electromagnetic elements in a neutral position; and a connecting plate, said connecting plate connecting said core elements to said valve stem;

wherein applying current to the coil in the upper electromagnetic element causes the valve to close, and interrupting the current to the coil in the upper electromagnetic element and applying current to the coil in the lower electromagnetic element causes the valve to open.

9. An electromagnetically actuated valve in accordance with claim 8 wherein said core element is substantially rhomboidal-shaped in vertical cross section.

10. An electromagnetically actuated valve in accordance with claim 9 wherein said rhomboidal-shaped core element further defines a central aperture.

11. An electromagnetically actuated valve in accordance with claim 8 including a first and a second pair of electromagnetic elements.

12. An electromagnetically actuated valve in accordance with claim 11 wherein the first pair of electromagnetic elements is stacked on top of the second pair of electromagnetic elements.

13. An electromagnetically actuated valve in accordance with claim 11 wherein the first pair of electromagnetic elements is disposed intermediate the valve stem and the second pair of electromagnetic elements.

14. An electromagnetically actuated valve in accordance with claim 8 further comprising a valve case, said valve case surrounding said electromagnetic elements and core elements, and further wherein an upper a lower surface of the valve case serves to bias the spring.

15. An electromagnetically actuated valve in accordance with claim 8 wherein said arc-shaped cross-section of said electromagnetic elements defines two angled electromagnetic element pole faces and the central channel, and further wherein said rhomboid-shaped core element further defines four core pole faces, said core pole faces being angled to correspond to the angled electromagnetic pole faces.

16. An electromagnetic actuator comprising:

at least one pair of electromagnetic elements, each pair of electromagnetic elements including an upper electromagnetic element and a lower electromagnetic element, said elements each having an annular horizontal cross-section defining a central chamber, and a substantially arc-shaped vertical cross-section, wherein said arc-shaped cross-section defines a central channel, and further wherein said central channels of said upper and lower electromagnetic elements are in facing relationship to each other;

at least one core element, said core element having an annular horizontal cross-section and being disposed intermediate said central channels of at least one pair of said electromagnetic elements;

a coil disposed within the central channel of each of said electromagnetic elements;

an actuator rod disposed within the central chamber of the electromagnetic elements, said actuator rod being connected to an external load;

a spring disposed within the central chamber of the electromagnetic elements, said spring biasing said electromagnetic elements in a neutral position; and a connecting plate, said connecting plate connecting said core elements to said actuator rod;

wherein sequentially applying current to the upper and lower electromagnets at a resonant frequency causes the actuator to resonate so as to actuate the external load.

* * * * *